US007875818B1

(12) United States Patent
Chen

(10) Patent No.: US 7,875,818 B1
(45) Date of Patent: Jan. 25, 2011

(54) SWITCH MODULE OF POWER SOCKET

(76) Inventor: Tsan-Chi Chen, 8F., No. 120-11, Chungshan Rd., Sec. 3, Chung Ho City, Taipei Hsien (TW)

( * ) Notice: Subject to any disclaimer, the term of this patent is extended or adjusted under 35 U.S.C. 154(b) by 0 days.

(21) Appl. No.: 12/574,992

(22) Filed: Oct. 7, 2009

(51) Int. Cl.
*H01H 1/00* (2006.01)

(52) U.S. Cl. ..... 200/284; 361/624; 439/212

(58) Field of Classification Search ..... 200/284, 200/454, 457, 458, 520, 553; 361/624; 439/114, 439/212, 856
See application file for complete search history.

(56) References Cited

U.S. PATENT DOCUMENTS 3,803,342 A * 4/1974 Stearley et al. ..... 174/59
4,758,172 A * 7/1988 Richards et al. ..... 439/212
5,196,987 A * 3/1993 Webber et al. ..... 361/624
5,375,036 A * 12/1994 Magdaleno ..... 361/673

* cited by examiner

*Primary Examiner*—Edwin A. Leon
*Assistant Examiner*—Vanessa Girardi
(74) *Attorney, Agent, or Firm*—Bacon & Thomas, PLLC

(57) ABSTRACT

A switch module includes a casing containing a power supply module and a press button, and recessions of the casing for accommodating and fixing first and second power conductive plates. The second power conductive plate is connected to the power supply module, and two positioning portions are protruded from the recession. A first conductive clamping plate is contained in one positioning portion and riveted with the corresponding power conductive plate, and the other one of the positioning portions contains an isolated portion and a second conductive clamping plate. A conductive extension plate of the second conductive clamping plate is passed through both sides of the casing and connected to another conductive portion of the power supply module, such that the second conductive clamping plate has a power polarity of the second power conductive plate when the power supply module is at a connection status.

7 Claims, 7 Drawing Sheets

SWITCH MODULE OF POWER SOCKET

FIELD OF THE INVENTION

The present invention relates to a switch module, in particular to a switch module used for a power socket and having a casing made by plastic injection molding or die casting, and the casing is connected with other components by riveting, and the switch module can be assembled automatically without requiring a soldering process or producing a polluted gas.

BACKGROUND OF THE INVENTION

Since every component of a conventional switch module of a power extension cord is connected by soldering, a casing of the switch module generally comes with upper and lower casings (as shown in FIG. 1A) engaged with each other and provided for containing related components. To achieve the insulation effect, the upper and lower casings are made of a plastic material, so that when a manufacturer solders each component, such as soldering a power conductive plate with a conductive clamping plate, the heat produced by the soldering process will be conducted to the casing quickly. Since the plastic material is not a heat-resisting material and may be melted easily, toxic gases are produced and the environment is polluted. After the casing is deformed by heat, the upper casing no longer can cover the lower casing tightly, and thus the defective rate will becomes larger. Furthermore, gases produced by heating the plastic material will be dispersed to other components having a lower temperature (without being affected by the soldering process) and solidified by the lower temperature and attached onto such components. As a result, the electric conductivity of the components will drop or other adverse effects will occur. Since the conventional switch module is assembled by a soldering process, the components are soldered manually one by one, and then the upper and lower casings are engaged to form the switch module, and thus the production rate is low. If an operator uses too little solder in the soldering process, an empty solder may occur and cause an unstable electric flow or even a power disconnection, or the soldering point may be weakened and loosened easily. If the operator uses too much solder, then an electric current passing through the switch module will be too large, and a large quantity of heat will be produced, such that the solder will be melted and the melted solder may flow to different soldering points of opposite polarities to result in a short circuit. Even worse, an accident may occur when using the switch module, and the reputation of the manufacturer and the safety of the user may be jeopardized.

To overcome the aforementioned problems, manufacturers design another switch module as shown in FIG. 1A, and the switch module comprises an upper casing 11, a lower casing 12, a press button 13, two power conductive plates 15 and two conductive clamping plates 16, wherein the lower casing 12 includes two corresponding support walls 121 protruded from the top of the lower casing 12, and disposed at a predetermined distance apart from both sides of the lower casing 12 for installing each power conductive plate 15 between each support wall 121 and both sides of the lower casing 12, and one of the conductive clamping plates 16 is integrally formed with one of the power conductive plates 15, and another conductive clamping plate 16 is connected to another power conductive plate 15 for receiving different polarities of the power supply of the power conductive plates 15 respectively, and such connection requires no soldering process. In addition, the upper casing 11 is covered onto the lower casing 12 and provided for covering all components installed in the lower casing 12, and an opening 111 is formed at the top of the upper casing 11, and the press button 13 is installed at the top of the upper casing 11 and connected to a power supply module (not shown in the figure) through the opening 111. When a user switches the press button 13 to control the power supply module, the conductive clamping plates 16 can be set to a power connection status or a power disconnection status. Therefore, manufacturers can assemble a plurality of switch modules 1 into the casing of a power extension cord, and insert the conductive clamping plates 16 of every switch module 1 into a socket hole, such that users can plug a power cord connector of an electronic device into a socket hole.

In FIGS. 1A and 1B, the aforementioned method can avoid the issues brought by the soldering process, but the power conductive plate 15 and a connecting portion 151 are integrally formed as a whole, and thus it is necessary to remove the material (as indicated by the dotted line 151A of FIG. 1B) between two adjacent the connecting portion 151 during a stamping process. As a result, the manufacture wastes too much material, and the price of the switch module remains relatively high (because the price of raw material increases day after day.) Since the conventional switch module has many soldering points, and each soldering point has the aforementioned problems, therefore the defective rate of the switch modules is high. Furthermore, the aforementioned assembling process includes a manual soldering procedure, not only slowing down the assembling speed and incurring a high labor cost, but also causing pollutions to the environment as well as the components installed in the switch module. Some manufacturers adopt the integrally formed power conductive plate and conductive clamping plate, but it will waste too much material. Therefore, it is an important subject for related manufacturers to design and develop a switch module to overcome the aforementioned problems and provide an automated production without requiring any soldering process.

SUMMARY OF THE INVENTION

In view of the aforementioned shortcomings of the prior art, the inventor of the present invention based on years of experience in the related industry to conduct extensive researches and experiments, and finally developed a switch module of a power socket in accordance with the present invention to overcome the shortcomings of the prior art, improve the production rate and yield rate of the products and provide a convenient and safe application for users.

Therefore, it is a primary objective of the present invention to provide a switch module of a power socket, and the switch module can be assembled automatically without using a soldering process, and the switch module comprises a casing formed by plastic injection molding or die casting, and containing a power supply module and a press button sequentially disposed therein, and a recession formed separately on two corresponding external sides of the casing for accommodating and fixing a first power conductive plate and a second power conductive plate respectively. The second power conductive plate is connected directly or indirectly with an end of an electrically conductive portion of the power supply module, and two positioning portions are protruded from an external periphery of one of the recessions, and a first conductive clamping plate is contained in one of the positioning portions and riveted to the corresponding power conductive plate, and the other positioning portion contains an isolated portion and a second conductive clamping plate sequentially, and an end of a conductive extension plate installed on the second conductive clamping plate can be passed through the two corresponding external sides of the casing and connected to another electrically conductive portion of the power supply module, such that if the power supply module is situated at a connection status, the second conductive clamping plate will have a power polarity of the second power conductive plate. With the design of a switch module of a power socket according to the present invention, manufacturers can produce components and casings in mass quantity, and also can assemble the switch module automatically to increase the production capacity. Since the components including the power supply module, the press button, the power conductive plate and the clamping plate are fixed by a riveting or embedding method, the aforementioned environmental pollution issue and adverse effect of components in the casing no longer exist, and thus the competitiveness of the manufacturers can be improved effectively.

DETAILED DESCRIPTION OF THE PREFERRED EMBODIMENTS

Figure 2:
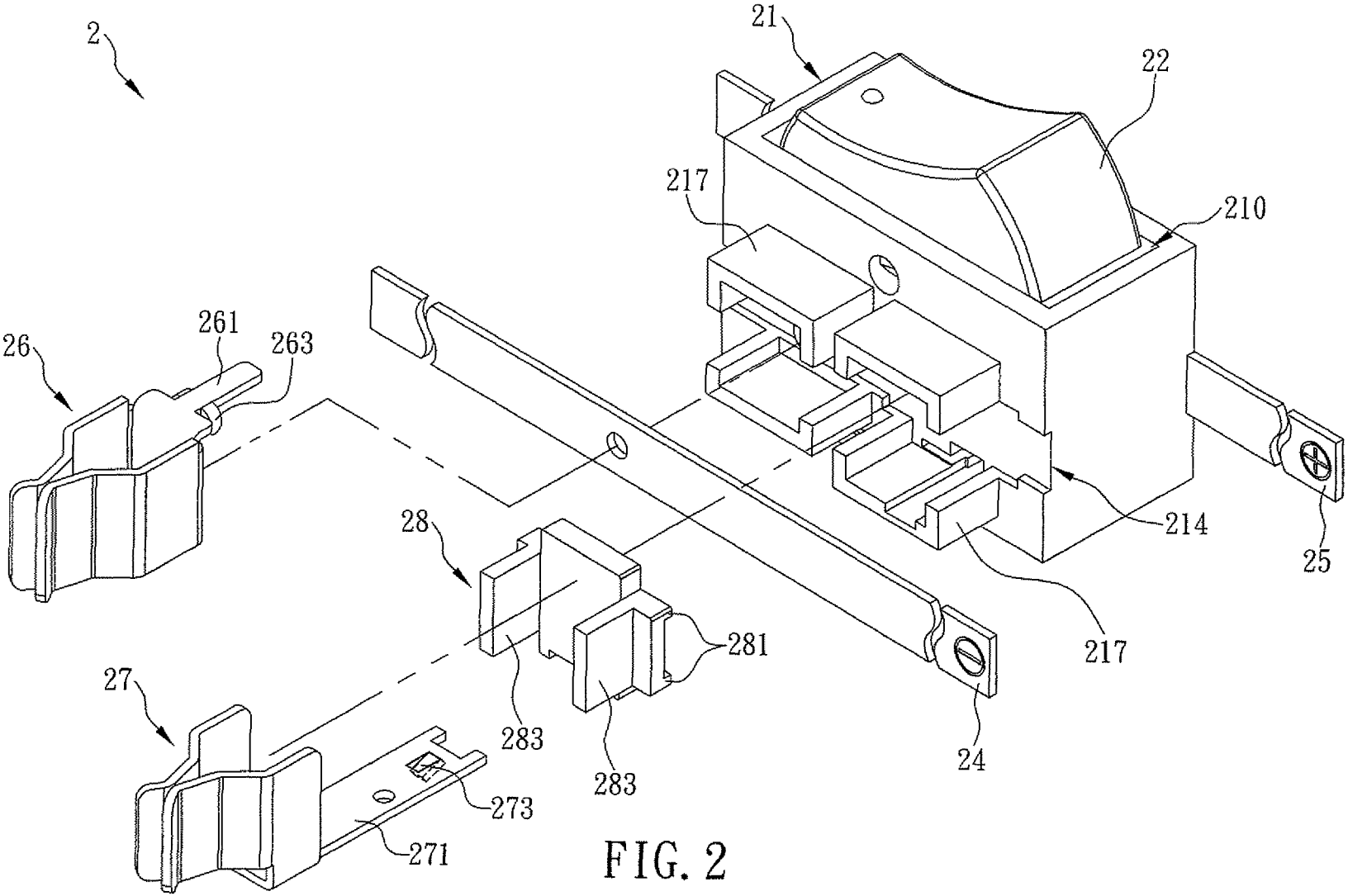
FIG. 2 is an exploded view of a switch module of the present invention viewed from a direction.
Figure 3:
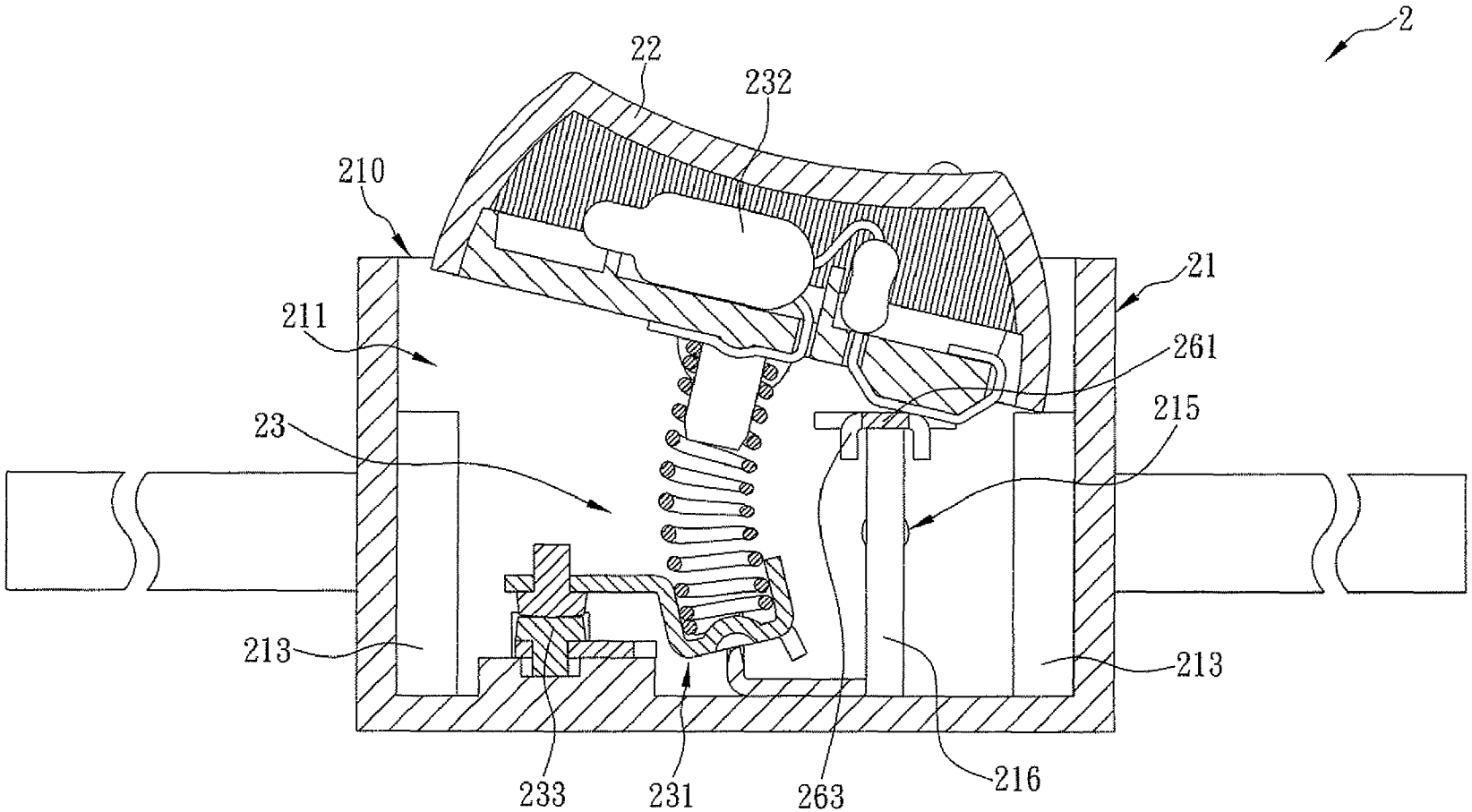
FIG. 3 is a cross-sectional view of a switch module of the present invention.

The present invention discloses a switch module of a power socket to overcome the shortcomings of the prior art. Since a conventional switch module requires a manual manufacturing procedure for the assembly, and the assembling procedure is complicated, and components are connected by a soldering process, therefore the conventional way of manufacturing a switch module not only ruins the structure of a casing, but also produces harmful gases. In the present invention, a switch module is integrally formed with the casing, and corresponding positions of a plurality of components of the switch module are designed in the casing according to the components to facilitate riveting or embedding the components. In a preferred embodiment of the present invention as shown in FIGS. 2 and 3, the switch module 2 comprises a casing 21, a press button 22, a power supply module 23, a first power conductive plate 24, a second power conductive plate 25, a first conductive clamping plate 26, a second conductive clamping plate 27, and an isolated portion 28. With reference to FIGS. 2 and 3 for an exploded view and a cross-sectional view of the switch module 2 of a preferred embodiment of the present invention respectively, the technical characteristics of the present invention are disclosed, wherein the casing 21 is formed by plastic injection molding or die casting, so that manufacturers can produce the casing 21 quickly and save the step of assembling upper and lower casings of the conventional switch module in the assembling procedure to reduce the manufacturing time effectively. In addition, an opening 210 is formed at the top of the casing 21, and a containing space 211 is formed in the opening 210 for containing the power supply module 23 and the press button 22, such that a user can switch the power supply module 23 to a power connection status by the press button 22, such that the power supply module 23 can be situated at a power connection status or a power disconnection status. It is noteworthy to point out that the overall structure of the switch module of the present invention is not limited to the aforementioned preferred embodiment only, but persons skilled in the art can modify the overall structure of the power supply module based on the technical characteristics of the present invention. As long as the power supply module can change the power connection status by the press button, such power module is covered by the scope of the present invention.

Figure 4:
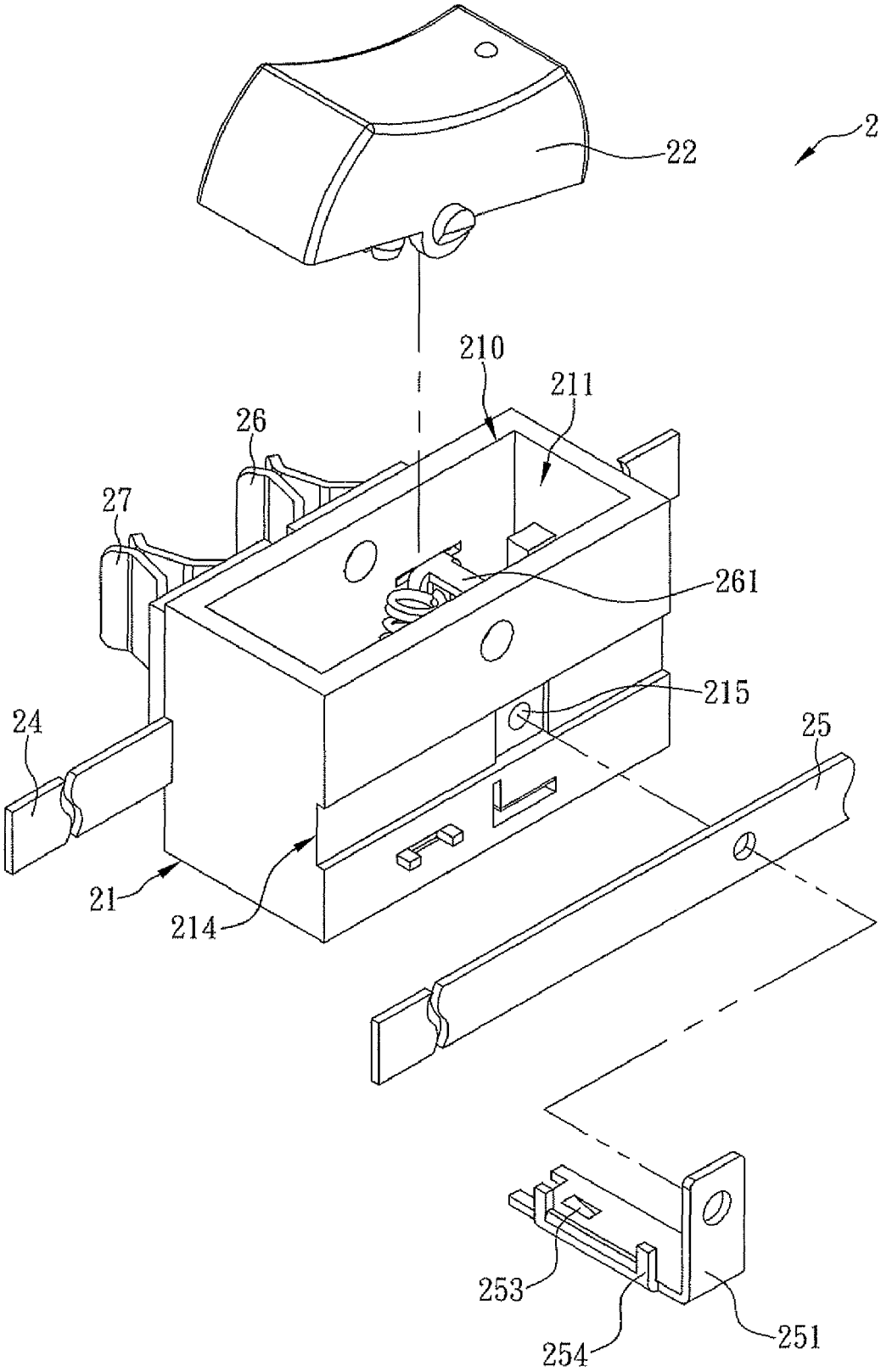
FIG. 4 is an exploded view of a switch module of the present invention viewed from another direction.
Figure 5:
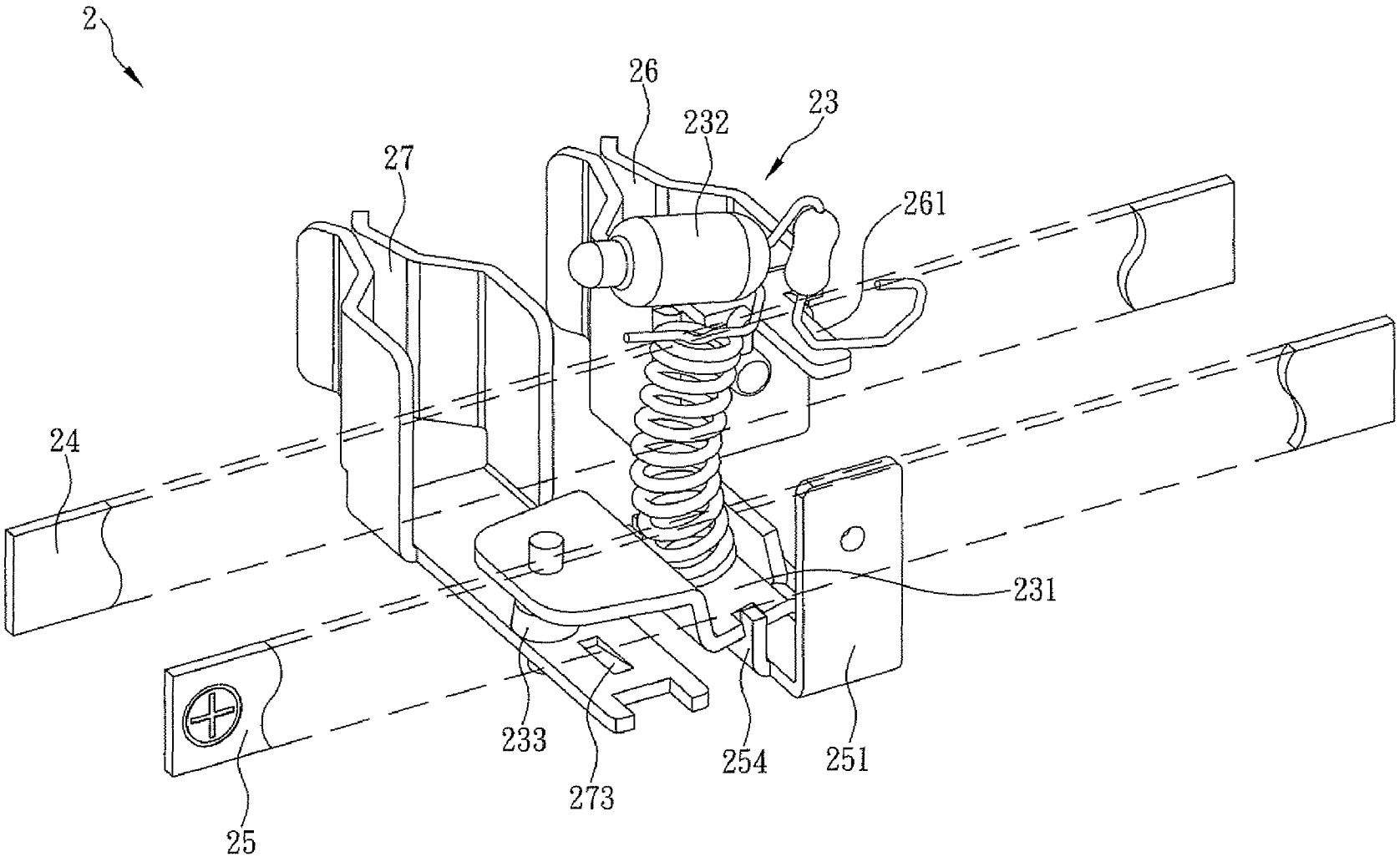
FIG. 5 is a schematic view of a power supply module connected with other components in accordance with the present invention.

In FIGS. 2 and 3, the casing 21 includes at least one stop block 213 disposed separately on two corresponding internal sides of the casing 21 and at a position proximate to the opening 210, such that if a user presses the press button 22 to move an end of the press button 22 in a direction towards the containing space 211 until the end of the press button 22 touches each stop block 213, the end of the press button 22 will be stopped by each stop block 213 and cannot move downward. If the user presses and moves another end of the press button 22 in a direction towards the containing space 211, the other end of the press button 22 will be stopped by the corresponding stop block 213 to prevent the user from pressing the press button 22 excessively and also prevent the press button 22 from pressing the power supply module 23 excessively or damaging the power supply module 23. With reference to FIGS. 2 and 4, FIG. 4 shows an exploded view of the switch module 2 of the present invention viewed from another direction, wherein a recession 214 is formed on two corresponding external sides of the casing 21 separately, and the two recessions 214 are disposed transversally and capable of accommodating the first power conductive plate 24 and the second power conductive plate 25 of different power polarities (such as an anode and a cathode) respectively, and the first power conductive plate 24 and the second power conductive plate 25 are riveted and fixed onto corresponding riveting holes 215 of the casing 21 respectively and integrally connected with the casing 21. To enhance the fixing strength of the second power conductive plate 25, the switch module 2 further comprises a connecting portion 251, and an end of the connecting portion 251 is riveted to the second power conductive plate 2, and an inverted hook 253 is formed at a position proximate to another end of the connecting portion 251, such that when the other end is passed through the two corresponding external sides of the casing 21, the inverted hook 253 is used for fixing onto the casing 21 to prevent the second power conductive plate 25 from falling off from the casing 21. With reference to FIG. 5 for a schematic view of a power supply module connected with other components in accordance with a preferred embodiment of the present invention, the connecting portion 251 further includes a U-shaped positioning plate 254 to prevent the electrically conductive portion 231 from being deviated from an original position, since an end of the electrically conductive portion 231 is restricted by the positioning plate 254 and cannot be deviated, and the second power conductive plate 25 is connected to the electrically conductive portion 231 indirectly through the connecting portion 251 for transmitting an electric current to the electrically conductive portion 231. It is noteworthy to point out that the second power conductive plate of another preferred embodiment of the present invention can be riveted to the electrically conductive portion of the power supply module directly through the corresponding riveting hole.

In FIGS. 2, 3 and 5, the casing 21 is provided for containing two positioning portions 217 protruded from an external periphery of the recession of the first power conductive plate 24, and one of the positioning portions 217 is provided for containing the first conductive clamping plate 26 and riveted to the first power conductive plate 24 and fixing the first conductive clamping plate 26 onto the casing 21, such that the first conductive clamping plate 26 has a power polarity (such as a cathode) of the first power conductive plate 24. In FIGS. 2 and 5, the first conductive clamping plate 26 includes a first conductive extension plate 261, and an end of an indicating lamp 232 of the power supply module 23 is connected to the first conductive extension plate 261, and another end of the indicating lamp 232 is connected to the electrically conductive portion 231 to constitute an electric circuit, such that the indicating lamp 232 can emit a light to inform a user about the normal transmission of an electric current of the power conductive plates 24, 25. In order to improve the stability of the first conductive clamping plate 26, the first conductive clamping plate 26 further includes two riveting plates 263 installed at positions proximate to the first conductive extension plate 261 and riveted to a protruded pillar 216 at an internal side of the casing 21 for fixing the first conductive clamping plate 26 onto the casing 21 securely and preventing the first conductive clamping plate 26 from being loosened easily by a user's plugging and unplugging movements. In addition, another positioning portion 217 of the casing 21 is provided for containing the isolated portion 28 and the second conductive clamping plate 27 sequentially. Since a side of the isolated portion 28 covers the first power conductive plate 24 in the positioning portion 217 completely, therefore the second conductive clamping plate 27 does not have the power polarity of the first power conductive plate 24, and the switch module 2 can be operated normally. The isolated portion 28 further includes at least one protrusion 281 disposed on a side of the isolated portion 28, and each protrusion 281 is embedded into a gap between the first power conductive plate 24 and the casing 21 to increase a creepage distance, so as to prevent the second conductive clamping plate 27 from receiving the power polarity of the first power conductive plate 24, and another side of the isolated portion 28 has two corresponding stop plates 283, and the second conductive clamping plate 27 can be accommodated between the two stop plates 283 for preventing a contact with the first conductive clamping plate 26. In addition, an end of a second conductive extension plate 271 of the second conductive clamping plate 27 is passed through two corresponding external sides of the casing 21 (as shown in FIG. 4), and an inverted hook 273 is disposed proximate to the end of the second conductive extension plate 271 for embedding and fixing to the casing 21, and the second conductive extension plate 271 is connected to another electrically conductive portion 233 of the power supply module 23 (which is a conductive contact in this preferred embodiment) such that if the power supply module 23 is switched to a connection status by the press button 22, another end of the electrically conductive portion 231 of the power supply module 23 can be contacted with the other electrically conductive portion 233, and thus the second conductive clamping plate 27 has a power polarity (such as an anode) of the second power conductive plate 25. If the power supply module 23 is switched to a disconnection status by the press button 22, the other end of the electrically conductive portion 231 of the power supply module 23 is separated from the other electrically conductive portion 233, such that the second conductive clamping plate 27 does not have any power polarity at all.

In FIGS. 2 and 3, if the user inserts two pins of a connector into the first conductive clamping plate 26 and the second conductive clamping plate 27, and the electrically conductive portion 231 and the other electrically conductive portion 233 are in contact with one another, the connector can receive a current transmitted from the power conductive plates 24, 25 through the conductive clamping plates 26, 27 to form an electric current loop. Since the casing 2 of the present invention is integrally formed, and the overall structure is designed according to required components of the switch module 2, and each component is connected to the casing 21 by riveting or clamping, and thus manufacturers can manufacture the switch module 2 by automated production. For example, the power supply module 23 and the press button 22 are put into the casing 21 sequentially, and the power conductive plates 24, 25 are riveted to two corresponding external sides of the casing 21, and the first conductive clamping plate 26 is riveted to the positioning portion 217, and the isolated portion 28 and the second conductive clamping plate 27 are latched and installed into another positioning portion 217 sequentially to produce the switch module 2 of the present invention. For the switch module of the present invention, manufacturers can manufacture the casing and each component more quickly to improve the production capacity of each component. Since the components including the power supply module, the press button, the power conductive plate and the clamping plate are fixed onto the casing by riveting or clamping, therefore manufacturers can manufacture a switch module by automation to reduce the assembling time of the switch module, eliminate human errors of the assembling process, and lower the labor cost, so as to enhance the market competitiveness of the manufacturers.

Figure 1A:
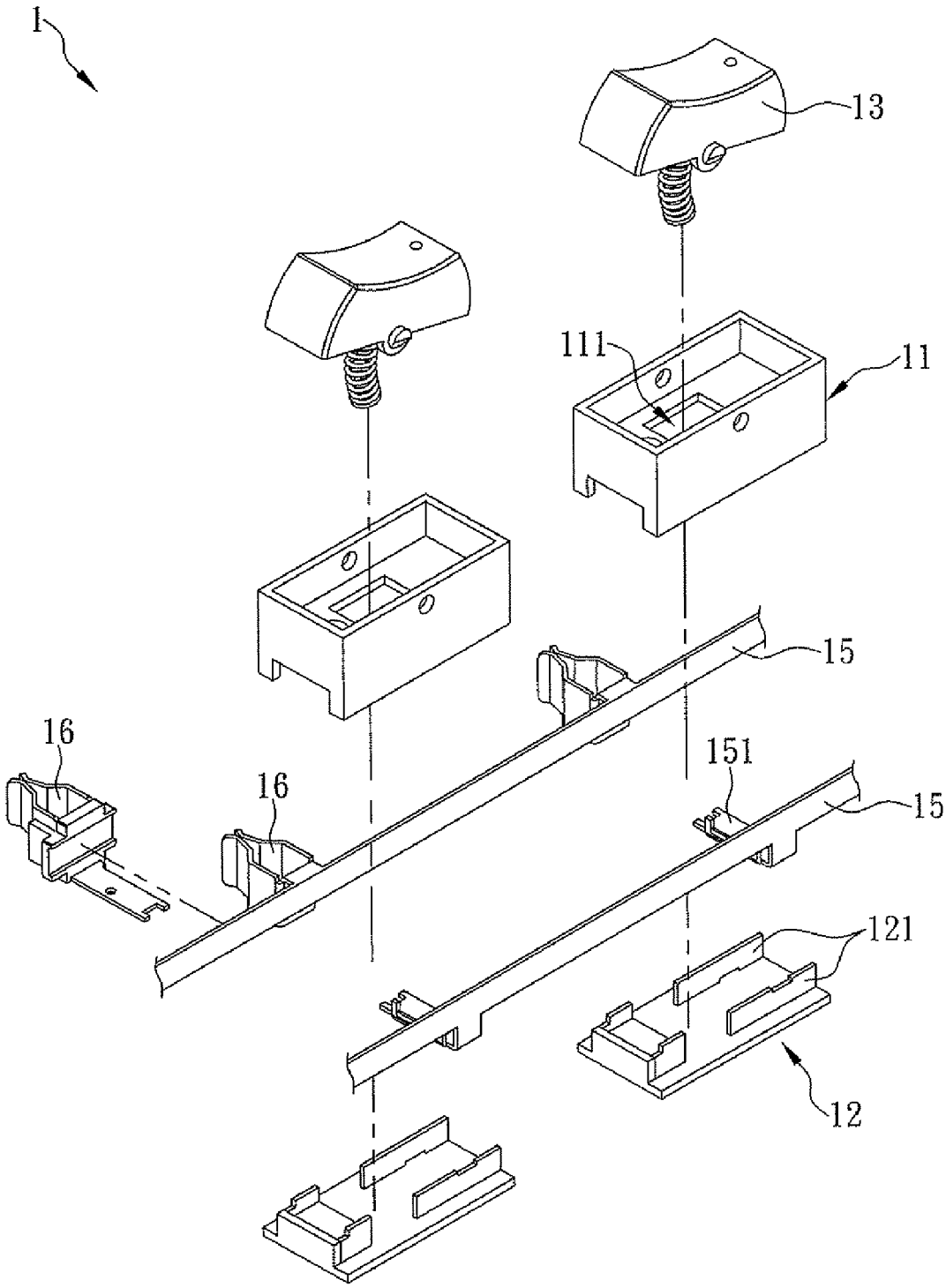
FIG. 1A (Prior Art)
FIG. 1A is an exploded view of a conventional switch module.
Figure 1B:
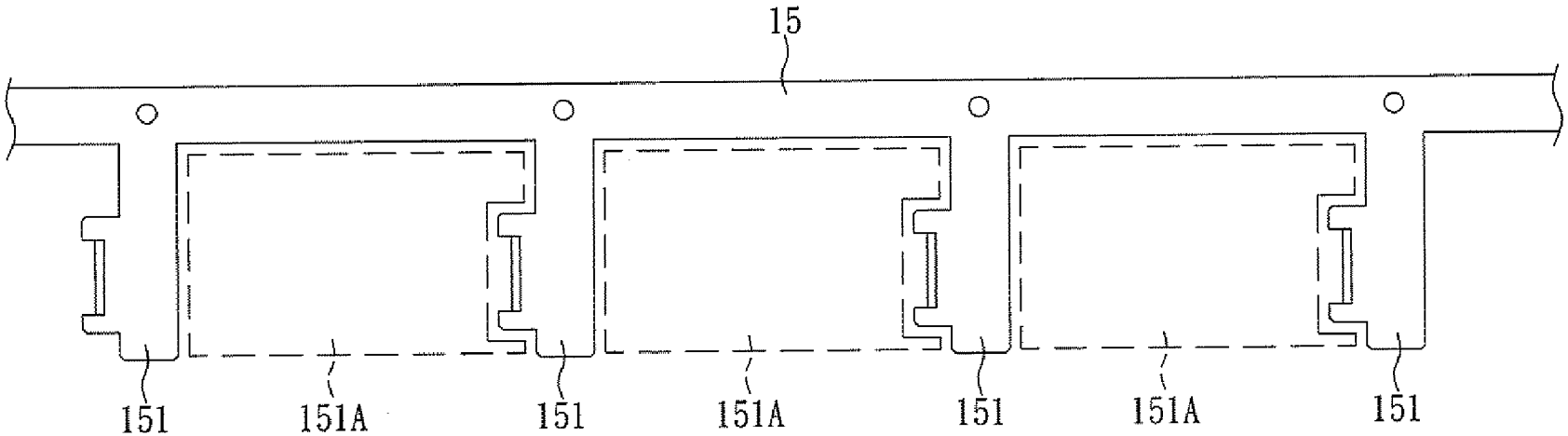
FIG. 1B (Prior Art)
FIG. 1B is a schematic view of a conventional power conductive plate and a conventional conductive clamping plate.
Figure 6:
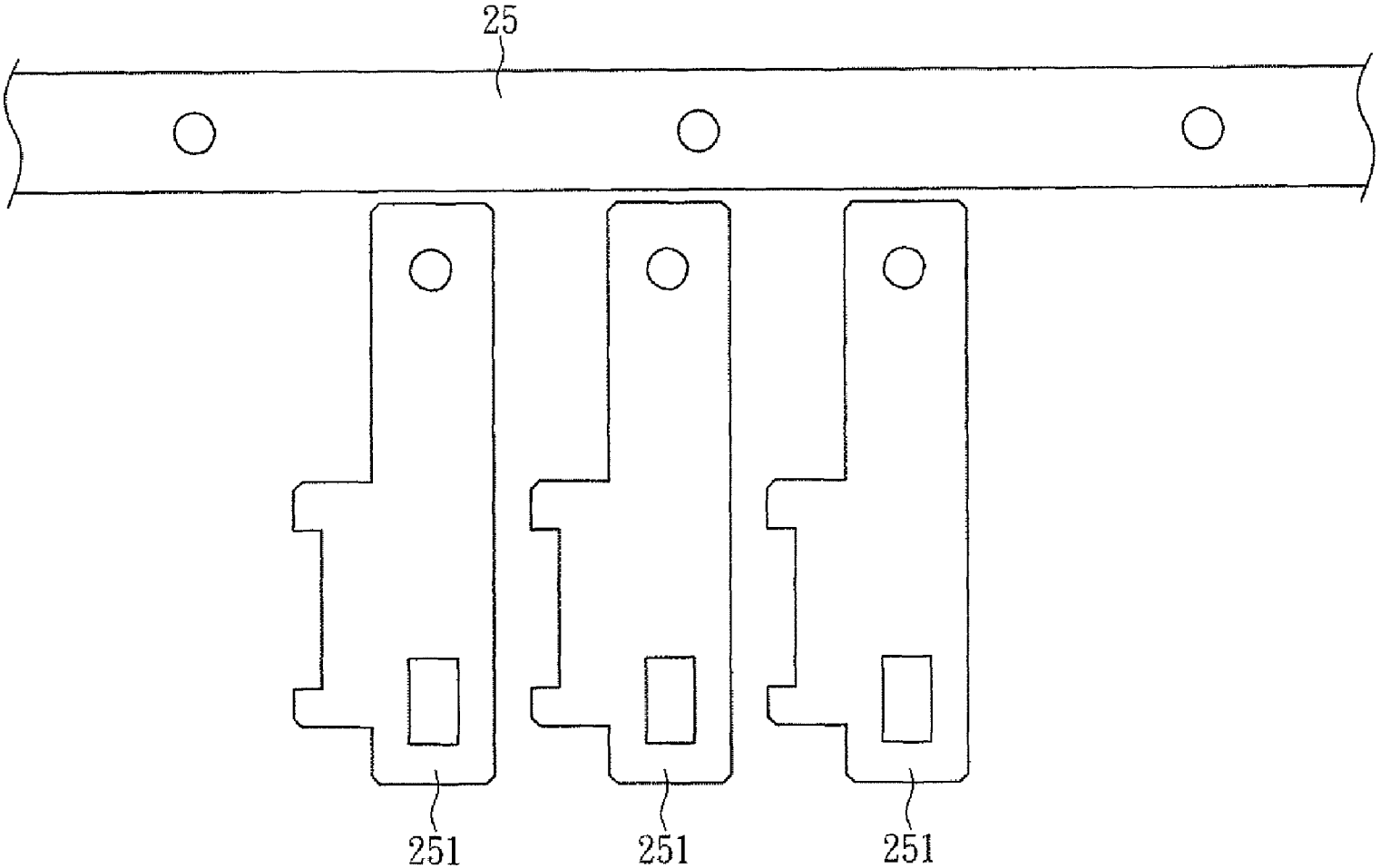
FIG. 6 is a schematic view of a power conductive plate and a conductive clamping plate in accordance with the present invention.

With reference FIGS. 1B and 6, the present invention adopts a riveting method to connect the second power conductive plate 25 and the connecting portion 251, and thus the present invention can overcome the shortcomings of the conventional power conductive plate 15 and the connecting portion 151 that waste too much material (as indicated by the dotted line 151A in FIG. 1B) in the manufacturing procedure. In summation, the present invention can save the manufacturing cost easily and provide an easy way for automated productions.

While the invention has been described by means of specific embodiments, numerous modifications and variations could be made thereto by those skilled in the art without departing from the scope and spirit of the invention set forth in the claims.

What is claimed is:

1. A switch module of a power socket, comprising:

a press button;

a power supply module, for being switched to a power connection status or a power disconnection status by the press button;

a first power conductive plate;

a second power conductive plate;

a casing, formed by a plastic injection molding or die casting process, and having an opening formed at the top of the casing, a containing space disposed at a corresponding position inside the opening for containing the power supply module and the press button sequentially, a recession formed on two corresponding external sides of the casing separately, and the two recessions being transversally disposed for containing the first power conductive plate and the second power conductive plate respectively, and the first power conductive plate and the second power conductive plate being riveted onto the casing through corresponding riveting holes of the casing respectively, and the second power conductive plate being connected directly or indirectly to an end of an electrically conductive portion of the power supply module for transmitting an electric current to the electrically conductive portion, and two positioning portions being protruded from an external periphery of the recession which is used for containing the first power conductive plate;

a first conductive clamping plate, contained in one of the positioning portions, and riveted onto the first power conductive plate for fixing the first conductive clamping plate onto the casing, and having a power polarity of the first power conductive plate;

an isolated portion, with a side contained into the other positioning portion, and a side of the isolated portion being capable of covering the first power conductive plate completely; and a second conductive clamping plate, contained in the other positioning portion and abutted against a side of the isolated portion, and having an inverted hook installed at an end of a conductive extension plate and the end of the conductive extension plate being passed through two corresponding sides of the casing and fixed onto the casing, and the second conductive clamping plate being coupled to another electrically conductive portion of the power supply module, such that when the power supply module is switched to a connection status by the press button, the second conductive clamping plate has a power polarity of the second power conductive plate, or when the power supply module is switched to a disconnection status by the press button, the second conductive clamping plate has no power polarity.

2. The switch module of claim 1, further comprising a connecting portion, with an end riveted onto the second power conductive plate, and having an inverted hook formed at a position proximate to the other end of the connecting portion, and the connecting portion being fixed onto the casing by the inverted hook when the other end of the connecting portion passes through two corresponding external sides of the casing.

3. The switch module of claim 2, wherein the first conductive clamping plate further includes two clamping plates for clamping a protruded pillar installed on an internal side of the casing.

4. The switch module of claim 3, wherein the isolated portion further includes at least one protrusion disposed on a side of the isolated portion, and embedded into a gap between the first power conductive plate and the casing for increasing a creepage distance.

5. The switch module of claim 4, wherein the isolated portion includes two corresponding stop plates disposed on the other side of the isolated portion, and the second conductive clamping plate is contained between the two stop plates.

6. The switch module of claim 5, wherein the first conductive clamping plate includes another conductive extension plate disposed thereon, and an end of an indicating lamp of the power supply module is connected to the another conductive extension plate, and the other end of the indicating lamp is connected to the electrically conductive portion.

7. The switch module of claim 6, wherein the casing includes at least one stop block disposed proximate to two corresponding internal sides of the opening separately, and each stop block is capable of stopping both ends of the press button, such that both ends of the press button cannot be displaced excessively in the containing space.

* * * * *